United States Patent [19]

Secrest, Jr.

[11] Patent Number: 4,887,717

[45] Date of Patent: Dec. 19, 1989

[54] PACKAGING WITH A GAUGE OR TOOL FORMED FROM THE PACKAGE

[75] Inventor: John C. Secrest, Jr., Manchester, Mo.

[73] Assignee: Secrest Engineered Products, Inc., Fenton, Mo.

[21] Appl. No.: 375,396

[22] Filed: Jul. 3, 1989

[51] Int. Cl.[4] ..... B65D 69/00

[52] U.S. Cl. ..... 206/575; 206/576; 206/223

[58] Field of Search ..... 206/216, 223, 574, 575, 206/569, 573, 576, 224, 459

[56] References Cited

U.S. PATENT DOCUMENTS

| | | | |
|---|---|---|---|
| 2,439,568 | 4/1948 | Hall . | |
| 2,705,555 | 4/1955 | Brenner . | |
| 2,805,516 | 9/1957 | Palm . | |
| 3,128,725 | 4/1964 | Becker et al. . | |
| 3,171,540 | 3/1965 | Douglas . | |
| 3,703,234 | 11/1972 | Howard . | |
| 3,765,044 | 10/1973 | Hanahan et al. . | |
| 4,055,292 | 10/1977 | Hosoya . | |
| 4,092,191 | 5/1978 | Jones | 206/575 |
| 4,336,884 | 6/1982 | Hart et al. | 206/575 |
| 4,416,632 | 11/1983 | Berman | 206/575 |
| 4,535,928 | 10/1985 | Capo . | |
| 4,650,111 | 4/1987 | Jahoda . | |

*Primary Examiner*—Joseph Man-Fu Moy

*Attorney, Agent, or Firm*—Rogers, Howell & Haferkamp

[57] ABSTRACT

A package that contains component parts of a carburetor tune-up kit is formed in a box-like configuration with a plastic overwrap that protects the component parts contained in the package from the environment outside the plastic. The package is configured to serve as a parts tray for the parts of the kit when the plastic overwrap has been removed. Four interconnected flanges at the top of the package together form a border around an access opening into the interior of the package. First and second members of an adjustable carburetor float gauge are formed integrally in two of the flanges. The first and second members are denoted in the flanges by perforated lines forming their boundaries. The perforated boundaries of the gauge members permit the members to be removed from the package and assembled into an adjustable carburetor float gauge shaped as a T square with a cross piece and linear rule, where the cross piece is mounted for sliding movement across the linear rule. The cross piece is also provided with gradations of different predetermined widths that are used in measuring the clearance between assembled parts of the carburetor kit contained in the package. The adjustable measuring gauge formed in the package material of the carburetor tune-up kit can inexpensively perform the job of various conventional measuring gauges.

22 Claims, 1 Drawing Sheet

FIG. 1.
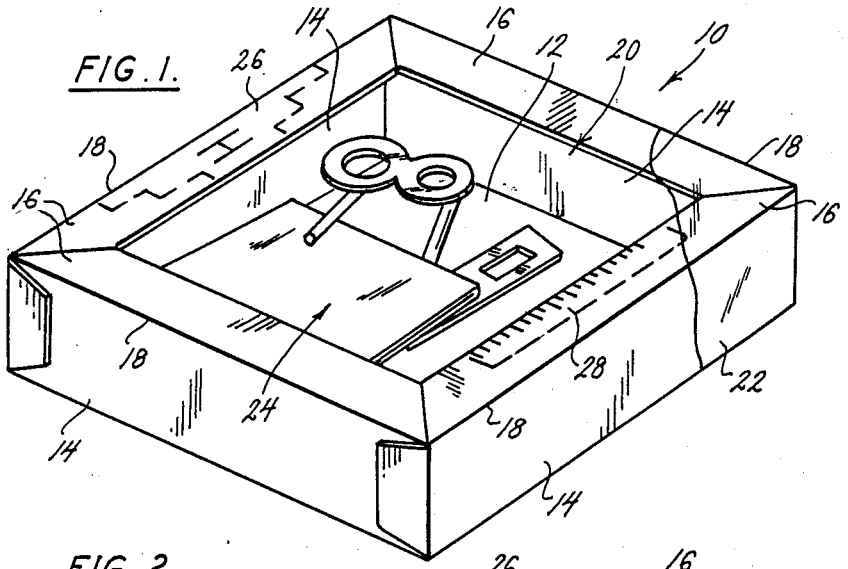
FIG. 2.
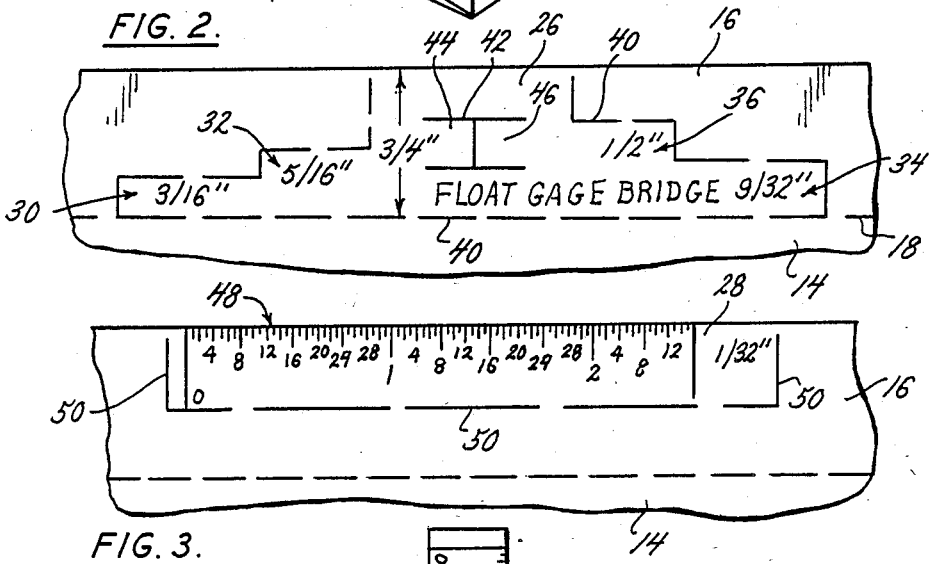
FIG. 3.
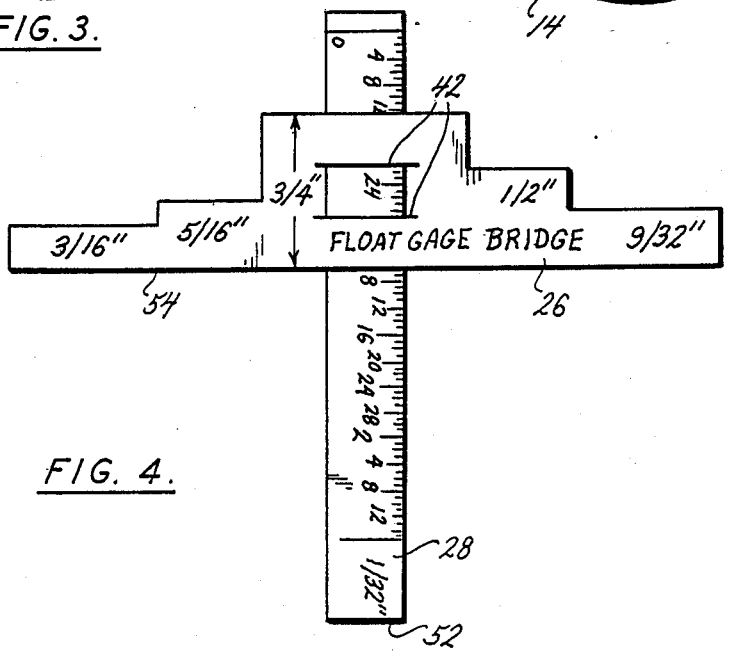
FIG. 4.

PACKAGING WITH A GAUGE OR TOOL FORMED FROM THE PACKAGE

BACKGROUND OF THE INVENTION (1) Field of the Invention

The present invention relates to packaging for containing a multiple of parts of an assembly, where the packaging includes an integrally formed tool or gauge that is adapted to be removed from the packaging and used in connection with the parts contained by the packaging. In particular, the packaging is formed with an integral measuring gauge that is adapted to be removed from the packaging and used to determine specific clearances between assembled parts contained by the packaging.

(2) Description of Related Art

Packaging of the type provided by the present invention is commonly used to store the component parts of carburetor tune-up kits. These kits generally contain an assortment of gaskets, springs, needle valve assemblies, and retainer pins that are to replace their corresponding parts in the carburetor being tuned up. These kits also often contain spacing or clearance gauges that are used in the reassembly of the tuned-up carburetor to insure that certain parts of the carburetor, for example the carburetor float, are reassembled with the proper spacing or clearance relative to other parts of the carburetor.

Because there are many different types of carburetors used in the many different years and makes of cars, the measuring gauge included among the parts of a given carburetor tune-up kit would necessarily be dimensioned to provide the specific spacing or clearance values required in reassembling the specific carburetor for which a given tune-up kit is manufactured. Manufacturing a specific measuring gauge to be included in the tune-up kit for a specific carburetor represents a significant portion of the overall manufacturing cost of the tune-up kit. In some carburetor tune-up kits, the cost of manufacturing the measuring gauge used in assembling the kit is more expensive than the cost of several of the parts contained in the kit.

More specifically, the carburetor float gauges included in tune-up kits are employed to determine the proper reassembled position of the carburetor float in the carburetor. Various types of conventional carburetor float gauges are available to perform the carburetor tune-up work. These gauges are available either separately from the tune-up kit, or included in the kit as one of the several component parts. Including a specific gauge in each of the many different types of carburetor tune-up kits manufactured represents a substantial portion of the consumer's cost for a kit. This cost is due to the manufacturing of separate gauges, the inventory of the various gauges required, and the handling and packaging of the various gauges.

Additionally, because the gauge is a small, separate item in the kit that is not used until the tune-up of the carburetor is almost completed, the possibility that the gauge will be misplaced during the course of the tune-up and will not be available when needed always exists.

It is an object of the present invention to provide a package that has an integrally formed measuring gauge that overcomes the aforesaid disadvantages of conventional measuring gauges included as component parts of carburetor tune-up kits. It is a further object of the present invention to provide a measuring gauge in the package that does the jobs of many different types of conventional measuring gauges. It is a still further object of the present invention to provide a measuring gauge in the package that eliminates the additional costs involved in the manufacturing, inventory, and handling associated with conventional carburetor measuring gauges, and eliminates the possibility of misplacing the measuring gauge prior to the completion of the carburetor tune-up.

SUMMARY OF THE INVENTION

The subject carburetor tune-up kit package has a rectangular configuration with a bottom panel and four interconnected side walls. A flange is connected to the top edge of each of the four side walls and extends out over the bottom panel of the package. The four flanges are interconnected and form a supportive frame around the top of the package and a border with a center opening that permits access to the contents of the package.

The package itself is wrapped in a clear plastic to protect component parts contained in the package from dust and moisture while they are in storage. The clear plastic permits visual inspection of the parts without opening the package. Removing the plastic wrap transforms the package into a parts tray that provides easy access to parts of a carburetor tune-up kit contained by the package.

A measuring gauge is formed integrally in the side wall flanges of the package. The measuring gauge is comprised of two parts, with each of the parts being formed integrally in opposing side wall flanges. The outlines of the two parts of the measuring gauge are denoted in each of the flanges by perforated lines that permit the parts of the gauge to be punched out of the flanges.

The two parts of the measuring gauge are adapted to be assembled into a T square with a movable cross piece. One part of the gauge makes up the linear rule of the T square, and the second part of the gauge makes up the cross piece. The cross piece is formed as a strip that is slidably received on the linear rule. A multiple of step gradations are formed on the opposite ends of the cross piece. The width of each gradation is predetermined to enable the use of the gradations as clearance gauges adapted to be inserted between assembled component parts contained by the package to insure their proper relative spacing.

The linear rule of the measuring gauge has a scale denoting 1/32 of an inch delineations along its length. The cross piece is adapted to slide along the length of the linear rule to an adjusted position a given distance from an end of the linear rule specified in the carburetor tune-up kit instructions. Specifically, the cross piece is positioned a given distance from the end of the linear rule specified in the instructions of the carburetor kit, and the gauge is then used to insure that the carburetor float is properly positioned the specified distance from a specified reference point of the carburetor.

Providing the adjustable float gauge integrally formed in the packaging for the carburetor tune-up kit substantially reduces the costs involved in the manufacturing, inventory, and handling of separate specialized gauges included in carburetor tune-up kits.

Because the gauge is part of the package that is normally used as a parts tray while performing carburetor repairs, it is always readily available when needed during the tune-up of the carburetor. In addition, forming the gauge integrally in the flanges of the side walls of the package permits the two measuring gauge parts to be removed from the package without affecting the usefulness of the package as a parts tray.

BRIEF DESCRIPTION OF THE DRAWINGS

Further objects and features of the present invention are revealed in the following detailed description of the preferred embodiment of the invention and in the drawing figures wherein:

FIG. 1 is a perspective view of the packaging of the present invention;

FIG. 2 is a segmented view of the cross piece of the measuring gauge integrally formed in a side wall flange of the package of the present invention;

FIG. 3 is a segmented view of the linear rule of the measuring gauge integrally formed in another side wall flange of the package of the present invention; and FIG. 4 is a view of the cross piece and linear rule parts of the measuring gauge removed from the flanges of the package and assembled to form the measuring gauge of the present invention.

DESCRIPTION OF THE PREFERRED EMBODIMENT

FIG. 1 shows the parts package 10 of the present invention. The package itself is comprised of a rectangular bottom panel 12 that is surrounded by four side walls 14. Flange members 16 extend a given distance from the top edge 18 of the side walls inward over the bottom panel of the package. The flanges 16 are all interconnected and provide additional strength to the package, and form a border around the top of the package that defines an opening 20 providing access to the interior of the package. The entire package is sealed by a clear plastic wrap 22 that protects the contents 24 of the package from exposure to dust or moisture from the environment outside the plastic wrap. As can be seen in FIG. 1, removal of the plastic wrap 22 from the package transforms the package into a reinforced parts tray that contains the component parts 24 of a carburetor tune-up kit, and permits easy access to the parts through the top of the package.

A two-part measuring gauge is formed integrally in two of the flanges of the package. The two parts of the gauge include a cross piece 26 and a linear rule 28. Each of the parts of the measuring gauge are denoted in opposed flanges of the package by perforated lines that completely outline the parts.

The first part, or cross piece 26, of the measuring gauge is shown in FIG. 2. The cross piece is shaped as a strip with a first pair of gradations 30, 32 formed on one side of the strip, and a second pair of gradations 34, 36 formed on the opposite side of the strip. A fifth gradation 38 is formed in the middle of the strip. The first and second gradations are adapted to be inserted between assembled parts of a carburetor to determine if the clearance between the parts is 3/16 of an inch or 5/16 of an inch, respectively. The third and fourth gradations are adapted to be inserted between assembled parts of a carburetor to determine if the clearance between the parts is 9/32 of an inch or ½ of an inch, respectively. The fifth gradation is adapted to be inserted between assembled parts of a carburetor to determine if the clearance between the parts is ¾ of an inch. Each of the gradation widths are printed on the top of the cross piece as shown in FIG. 2. The entire exterior boundary 40 of the cross piece is denoted by a perforated line 40. By breaking the connections between the cross piece and the flange along the perforated line 40, the cross piece can be removed from the flange of the parts package. A series of cuts 42 are made in the center of the cross piece. The cuts form a pair of tabs 44, 46 that enable the cross piece to be assembled onto the linear rule in a manner to be described.

The linear rule 28 of the measuring gauge is shown in FIG. 3. The rule is formed as a rectangular strip with a measuring scale 48 delineated along one side of the rule. The scale is divided into lengths of 1/32 of an inch. The exterior boundary 50 of the linear rule is also denoted by a perforated line 50. The linear rule is removed from the flange by breaking the connections between the linear rule and the flange along the perforated line.

In order to enable the measuring guide of the invention to be used in measuring relative distances between assembled parts of a carburetor rebuilt from a kit contained by the package, the measuring gauge must first be removed from the package and assembled in the manner shown in FIG. 4. In assembling the measuring gauge, the cross piece tabs 44 and 46 formed by the cut lines 42 are first pressed downwardly from the top of the cross piece toward the bottom of the cross piece. The linear rule 28 is next inserted below the cross piece but above the pair of depressed tabs 44, 46 as shown in FIG. 4. This assembly enables the cross piece 26 to slide over the surface of the linear rule 28 to adjust the linear measurement from the end 52 of the linear rule to the bottom edge 54 of the cross piece. The cross piece can be adjusted relative to the linear rule to measure specific distances, for example the distance between the carburetor float and some other reference point on the rebuilt carburetor. To insure the accuracy of measurements made with the assembled measuring gauge, the end 52 of the linear rule 28 is trimmed back to the zero reading at the beginning of the scale delineated on the linear rule. The directions for assembling and using the float gauge can be included in the instructions for rebuilding the carburetor in the tune-up kit, or they may be imprinted on the surfaces of the package side wall flanges or other suitable location.

The plurality of clearance measurements provided by the gradations of the crosspiece and the adjustable distance measure provided by the linear rule enable the measuring gauge to be used in the reassembly of many different types of carburetors. Forming the measuring gauge integrally in the flanges of the parts package as described above eliminates the additional costs of manufacturing, inventory, and handling associated with conventional measuring gauges that are included with the component parts of the carburetor tune-up kit. By imprinting the parts of the measuring gauge into the precut sheet of material that is to be formed into the package, the cost of the gauge is incorporated into the production cost of the package and is very minimal. Because the gauge is part of the package and the package is normally used as a parts tray by the technician performing the tune-up to the carburetor, the gauge is always readily available when needed.

Although the package of the present invention is described as containing the parts of a carburetor tune-up kit, it is not intended that the package be limited to this use. The package may contain any item or items with which a readily available measuring gauge or tool would be useful.

While the present invention has been described by reference to a specific embodiment, it should be understood that modifications and variations of the invention may be constructed without departing from the scope of the invention defined in the following claims.

What is claimed is:

1. A container adapted to hold a plurality of component parts of an assembly and to be used in assembling the component parts of the assembly, the container comprising:

a bottom panel;

side wall means surrounding the bottom panel and together with the bottom panel defining a tray having an interior volume that is accessible from its top and is adapted to hold a plurality of component parts of an assembly; and a measuring gauge formed integrally in one of the bottom panel and side wall means of the tray, the gauge being adapted to be removed from the bottom panel or side wall means to enable use of the gauge in connection with component parts held by the tray.

2. The container of claim 1 comprising:

the gauge being adapted to be removed from the side wall means without affecting the usefulness of the container as a parts tray.

3. The container of claim 1 comprising:

the measuring gauge being adapted to be used in measuring linear distances.

4. The container of claim 1 comprising:

the measuring gauge being constructed of two parts, one of the parts being a linear rule and the other of the parts being a cross piece adapted to slide over the rule.

5. The container of claim 1 comprising:

the measuring gauge being constructed as a T square with a rule and cross piece, the cross piece being adapted to be slid along the rule of the T square.

6. The container of claim 1 comprising:

the measuring gauge being constructed from two separate parts, with each of the parts being formed integrally with one of the bottom panel and side wall means of the tray, the gauge parts being adapted to be removed from the bottom panel or side wall means and assembled together to form the gauge.

7. The container of claim 1 comprising:

the tray being wrapped in a clear plastic that enables visual inspection of the interior volume of the tray from the top, and prevents exposure of the interior volume of the tray to the environment outside the plastic.

8. A package that is adapted to contain a plurality of parts of an assembly and to be used in assembling the parts of the assembly, the package comprising:

a precut sheet of material that is folded into a rectangular configuration having a bottom panel and four side walls, the bottom panel and four side walls defining a parts tray adapted to hold a plurality of parts of an assembly; and a measuring means formed integrally in the precut sheet of material and denoted by a perforated outline in the material, the measuring means being adapted to be removed from the precut sheet along the perforated outline to enable its use in connection with parts of an assembly held by the parts tray.

9. The package of claim 8 comprising:

the measuring means having first and second members, each formed integrally in the precut sheet of material and denoted by a perforated outline, the first member being a linear rule and the second member being a clearance gauge.

10. The package of claim 8 comprising:

the measuring means having first and second members formed integrally in the precut sheet and denoted by perforated outlines, the members being adapted to be removed from the sheet along their perforated outlines and assembled together into an adjustable measuring device that is adapted to be used in assembling parts of an assembly contained in the package.

11. The package of claim 9 comprising:

the first and second members being adapted to be removed from the sheet of material along their perforated outlines and used in assembling parts of an assembly held by the parts tray by measuring relative distances between assembled parts of the assembly.

12. The package of claim 8 comprising:

the measuring means having first and second members that are formed integrally in the precut sheet of material and denoted by perforated outlines, the first and second members being adapted to be removed from the material and assembled together to form a T square with the first member being a linear rule and the second member being a cross piece that slides over the rule when assembled.

13. The package of claim 9 comprising:

the first and second members being adapted to be removed from the sheet of material along their perforated outlines and assembled together into a T square with the clearance gauge being a cross piece of the T square that is adapted to be slidably received on the linear rule.

14. The package of claim 9 comprising:

the second member being formed as a strip with several gradations at its opposite ends, the gradations having predetermined widths to enable their being used to measure clearances between assembled parts of an assembly contained by the package.

15. A package adapted to contain a plurality of parts of an assembly and adapted to be used in assembling the parts, the package comprising:

a bottom panel having a rectangular configuration;

four side walls connected to and extending upward from the bottom panel, the four side walls being interconnected and together with the bottom panel defining an interior volume of the package;

four flange members, one connected to the top of each side wall and projecting out a given distance from the side wall over the bottom panel, the four flange members being interconnected, thereby defining a top access opening into the interior volume and providing structural support to the package; and a measuring rule means formed integrally in at least one of the flange members, the measuring means being adapted to be removed from the one flange member to enable the measuring means to be used in assembling the contents of the package.

16. The package of claim 15 comprising:

the measuring rule means having first and second parts, the first part being formed integrally in the one of the flange members and the second part being formed integrally in another of the flange members.

17. The package of claim 16 comprising:

the first part of the measuring rule means being formed as a linear rule and the second part of the measuring rule means being formed as a cross piece, the cross piece being adapted to be assembled on and to slide over the linear rule.

18. The package of claim 15 comprising:

the measuring rule means having first and second parts formed integrally in a first and second flange of the four flange members, the first and second parts being adapted to be removed from the first and second flanges and assembled together to produce an adjustable linear rule.

19. The package of claim 18 comprising:

the first part of the measuring rule being a linear rule and the second part of the measuring rule being a cross piece adapted to be assembled on and to slide over the linear rule.

20. The package of claim 19 comprising:

the cross piece being formed as a strip with stepped gradations at its opposite ends, the gradations having different predetermined widths enabling their use in measuring clearances between assembled parts of an assembly contained in the package.

21. A container adapted to hold a plurality of component parts of an assembly, and to be used in connection with the component parts of the assembly, the container comprising:

a box having a plurality of side walls adapted to hold a plurality of component parts of an assembly; and a measuring gauge formed integrally in one of the side walls of the box, the gauge being adapted to be removed from the one side wall and used in connection with the component parts held by the box.

22. A package that is adapted to contain a plurality of parts of an assembly and to be used in connection with the component parts, the package comprising:

a precut sheet of material that is folded into a box-like configuration and adapted to hold a plurality of component parts of an assembly; and a measuring means formed integrally in the precut sheet of material and denoted by a perforated outline in the material, the measuring means being adapted to be removed from the precut sheet along the perforated outline and used in connection with parts of an assembly held by the package.

* * * * *